US009980584B2

(12) United States Patent
Carey

(10) Patent No.: US 9,980,584 B2
(45) Date of Patent: May 29, 2018

(54) QUILT FORMED IN TWO SEPARATE PARTS WHICH CAN BE JOINED TOGETHER

(71) Applicant: Kevin John Carey, Scarborough (AU)

(72) Inventor: Kevin John Carey, Scarborough (AU)

( * ) Notice: Subject to any disclaimer, the term of this patent is extended or adjusted under 35 U.S.C. 154(b) by 61 days.

(21) Appl. No.: 15/281,758

(22) Filed: Sep. 30, 2016

(65) Prior Publication Data

US 2017/0095095 A1 Apr. 6, 2017

(30) Foreign Application Priority Data

Oct. 1, 2015 (AU) ..... 2015101431

(51) Int. Cl.
*A47G 9/04* (2006.01)
*A47G 9/02* (2006.01)

(52) U.S. Cl.
CPC ..... *A47G 9/0207* (2013.01)

(58) Field of Classification Search
CPC .... Y10T 428/24008; Y10T 428/24017; A47G 9/023; A47G 9/0223
See application file for complete search history.

(56) References Cited

U.S. PATENT DOCUMENTS

2015/0305523 A1* 10/2015 Zimmermann ..... A47G 9/023 5/486

* cited by examiner

*Primary Examiner* — Alexander Thomas
(74) *Attorney, Agent, or Firm* — Steven M. Greenberg; CRGO Law

(57) ABSTRACT

The disclosed "Quilt" is in two "Parts", each Part having a level of insulation which is independent of the other Part. For example, one "Part" can be extremely warm, and the other "Part" can be extremely cool. Both "Parts" can then be joined together to form a "Quilt". When juxtaposed the two separate "Parts" of the "Quilt", are a reverse image of each other, sharing both Negative and Positive componentry of a joiner. In this instance a Hook and Loop fastener is sewn into the joining "Channel Wall" of each "Part". The Hook Fastener tape is sewn along one half of the edge of the joining "Channel Wall" to the middle of the "Channel Wall", and the other half of the joining "Channel Wall" is sewn with a Loop Fastener tape. This arrangement permits both "Parts" can be purchased separately, and joined together allowing the individual to choose their own level of thermal resistance independently, while still being joined up with another individual's chosen thermal resistance.

4 Claims, 5 Drawing Sheets

QUILT FORMED IN TWO SEPARATE PARTS WHICH CAN BE JOINED TOGETHER

CROSS-REFERENCE TO RELATED APPLICATIONS

This application claims priority under 35 U.S.C. § 119(a) to Australian Patent Application Serial Number 2015101431 filed Oct. 1, 2015 entitled "A QUILT THAT CAN BE PURCHASED IN TWO SEPARATE PARTS AND JOINED TOGETHER" the entirety of which is incorporated herein by reference.

BACKGROUND

The present invention relates to a "Quilt" (which is also known as a Duvet, or Doona, depending on the country, or origin of the individual, but herein shall be termed a "Quilt") that is formed in two individual halves (that for the purposes of this application shall be known as "Parts" in order to differentiate from segments of the Quilt) and which can be joined together, no matter what "Part" is selected, allowing for an independent choice of thermal resistance for an individual for their side of the bed.

For many years "Quilts" have been styled in a manner to cover the whole of the bed surface in one piece. This creates a consistent warmth, or thermal resistance, across the bed, and presents an even cover on the top of the surface of the bed. However as people are of different warmths or body temperatures i.e. one person can be colder than the other person, this can make for a disturbing night's sleep for one, or both parties. One person could feel that a covering provides a perfect temperature whilst the other person could be too hot, or too cold. Previous attempts at manufacturing "Quilts" in different portions, relied on conventional methods of joining them together say by zip, or buttons. However as the joining mechanism was not reversible to provide both a negative and positive section on each "Part" of the "Quilt." The Parts of the prior art Quilts could not be provided (e.g. sold) separately, and this therefore limited the number of variations that could be applied to suit an individual, making such Quilts difficult to market as up to 250 combinations or more in each size could be needed if allergies, thermal resistance variations, and preference of the filling were taken into account.

DESCRIPTION OF THE INVENTION

The present invention is designed to eradicate this problem by offering a choice of warmth for each party sharing the same bed, and giving them a level of thermal resistance on their chosen side of the bed that is more suitable to them, independently, at the time of selection, whether it be cooler, or warmer than the other half. Likewise each party can have an independent choice of filing even if the level of thermal resistance is identical to the other Party. Both "Parts" are then joined together to make up one whole "Quilt".

Thus the present invention provides a quilt comprising: first and second quilt parts, wherein each quilt part has a thermal resistivity and the thermal resistivity of the first quilt part is different to the thermal resistivity of the second quilt part, and wherein each part has uppermost and lowermost surfaces and a channel wall disposed art a peripheral end of the quilt part, wherein the channel wall consists of a flat surface that extends between respective peripheral ends of the uppermost and lowermost surfaces of the quilt part and is orientated substantially perpendicular to the uppermost and lowermost surfaces; and has a plurality of hook or loop fasteners disposed on the surface, whereby, the hook or loop fasteners disposed on the flat surface of the channel wall of the first quilt part are releasably attachable to the hook or loop fasteners disposed on the flat surface of the channel wall of the second quilt part for releasably attaching the two quilt parts together.

Optionally, the flat surface of the channel wall of each quilt part comprises; A first surface section having a plurality of hook fasteners disposed on the first surface section; and a second surface section having a plurality of loop fasteners on the second surface section.

Optionally, each quilt part has one or more attachment means disposed on the uppermost and lowermost surfaces of the quit part, each attachment means being adapted to attach the quilt releasably to an overlying or underlying quilt part.

Conveniently at least one of the attachment means comprises hook or loop fasteners. Alternatively, at least one of the attachment means comprises a zip.

The levels of warmth can be determined by either a "Tog Rating" being allocated to each "Part" of the "Quilt", or by colour coding the warmth in grades of thermal resistance, or both. No matter what type of Part is selected it will always join to the other Part to form a whole Quilt as is set out in the figures shown.

The Quilt according to the present invention can be formed in two "Parts" Each {art can be formed in a single piece or can comprise two segments (herein segments may also be termed "Portions") utilizing the "Four seasons" method. (The "Four Seasons" method is a design in the market place that separates the covering into layers allowing for one "portion" to be separated from another to vary the thermal resistance for winter, or summer or vary again for autumn and spring.) After the two separate "Parts" of the "Quilt" are joined together it then completes the "Quilt". The joining mechanism can be either, but not restricted to, zips, buttons, hook and loop fasteners, studs, etc. How the two Parts are fastened together is not important, but rather the fact that the "Quilt" can be purchased in two separate "Parts" of varying qualities, such as thermal resistance, and can be linked together with another "Part" whether it be heavier, lighter, warmer, or cooler, or using a different material. Any suitable material can be used, including, but not restricted to, wool, feather, down, polyethylene terephthalate, polyester, microfibre, cotton or a mixture of such materials. the two Parts will always join together as long as the two "Parts" are manufactured in the same manner, is the concept described herein.

The method of manufacture that is demonstrated herein is preferred due to its ease of manufacture, and functionality. For instance a 500 gram per square meter wool "Quilt" "Part" joined with a 300 gram per square meter Wool "Quilt" "Part", would be substantially warmer than the latter "Part" and also heavier, giving the person on that half of the "Quilt", a higher amount of thermal resistance than the other person on the side where the 300 gram per square meter wool "Part", is used.

BRIEF DESCRIPTION OF THE DRAWINGS

The invention is further described with reference to the figures in which.

DETAILED DESCRIPTION OF THE DRAWINGS

Figure 1:
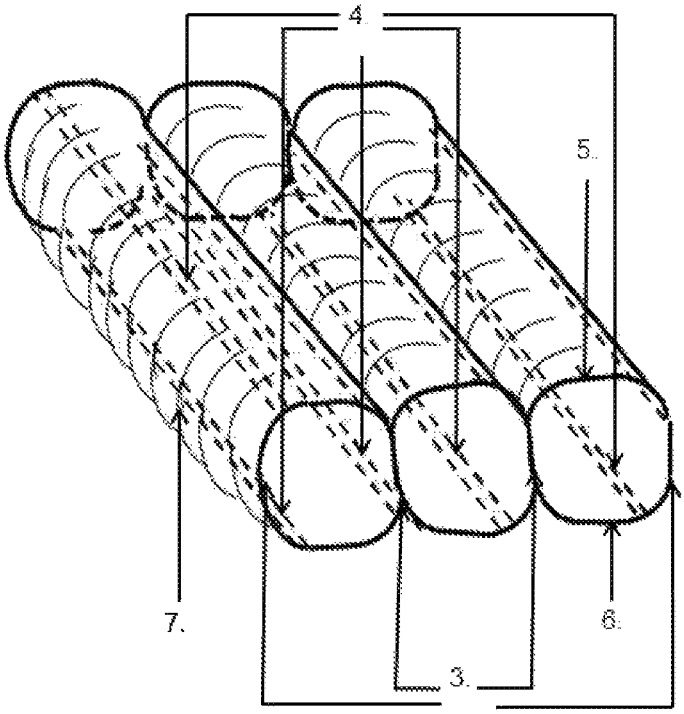
FIG. 1 is a schematic representation of a portion of a Quilt Part according to one embodiment of the present invention and shows the channel wall within the Part.

FIG. 1 shows a portion of a "Quilt" (7) according to the present invention with channel walls (3), being present to assist the loft or thickness of a "Quilt", making it appear fluffier or fuller, and to assist in a more even thermal resistance across the "Quilt". Thus, rather than the stitching going through from the top to the bottom of the "Quilt" (see FIG. 2), like tradition "Quilts", a strip of material (3) (herein referred to a "channel wall") is sewn (4) into each "Channel" of the "Quilt", thereby joining the top (5) to the bottom (6) at regular intervals across the quilt (7). This arrangement allows for more fill to be placed in to the channel, prevents the fill from being displaced within the interior during use, and leaving the surfaces (5,6) of the Quilt flatter in appearance.

Figure 2:
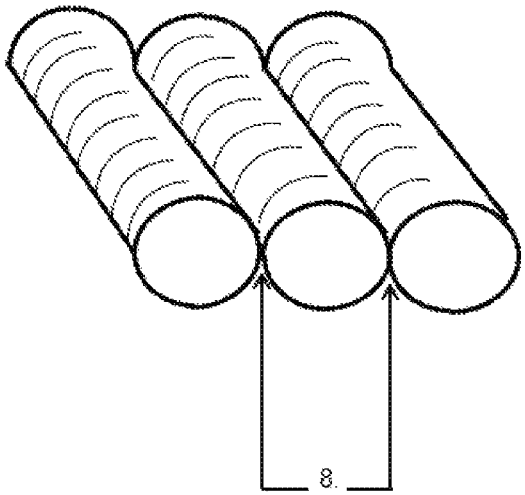
FIG. 2 is a schematic representation of a portion of a traditional quilt.

FIG. 2 depicts a traditional "Quilt" with the stitching sewn through from the top fabric through to the bottom fabric to form a "Channel" for the filling of the "Quilt" to be inserted. As you can plainly see in this Figure a less even surface results, and due to the stitching going through from the top to bottom less, or no fill is within this area leaving it with less thermal resistance.

Figure 3:
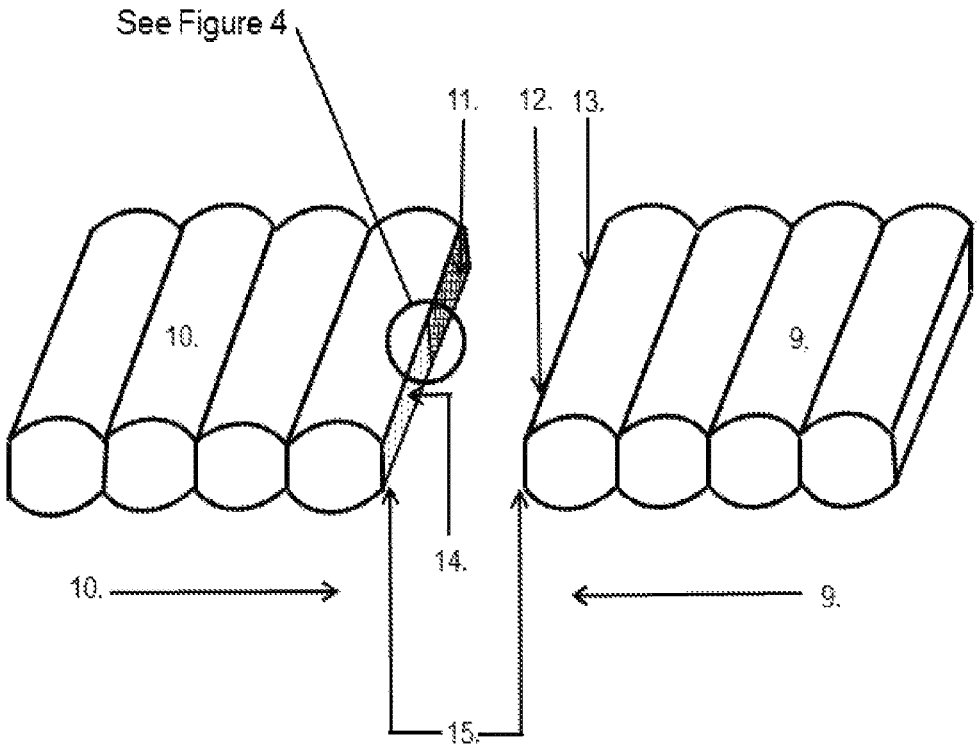
FIG. 3 is a schematic representation of two Parts of a Quilt according to the present invention.

FIG. 3 illustrates the preferred form of manufacture as its ease to be made, and its ability to be utilized is the simplest form known to me. FIG. 3 shows one "Part" (9) of the "Quilt", which is formed independently from a separate Part (10) of the Quilt. Parts (9, 10) can be joined together in the middle through a hook and loop fastener, which is sewn into the length of the joining "Channel Wall" (15) on each of the Quilt Parts (9, 10). In each of Parts (9, 10), one half of the "Channel Wall" (15) is sewn with a loop fastener tape (11, 12), and the other half of each Channel Wall for Parts (9, 10) is sewn with a hook fastener tape (13, 14). (See inset FIG. 4 for a closer view). Therefore, as long as both Parts (9, 10) are manufactured in the same way each "Part" will always join up with another "Part" to form a "Quilt", irrespective of the thermal qualities or material used to make a "Part." For instance a 500 gram per square meter Wool "Quilt" "Part", joined with a 300 gram per square meter Wool "Quilt", "Part", would be substantially warmer than the latter "Part", and also heavier, giving the person using that "Part" of the "Quilt", a higher amount of thermal resistance than the other person on the side where the 300 gram per square meter Wool "Quilt" "Part", is used.

Figure 4:
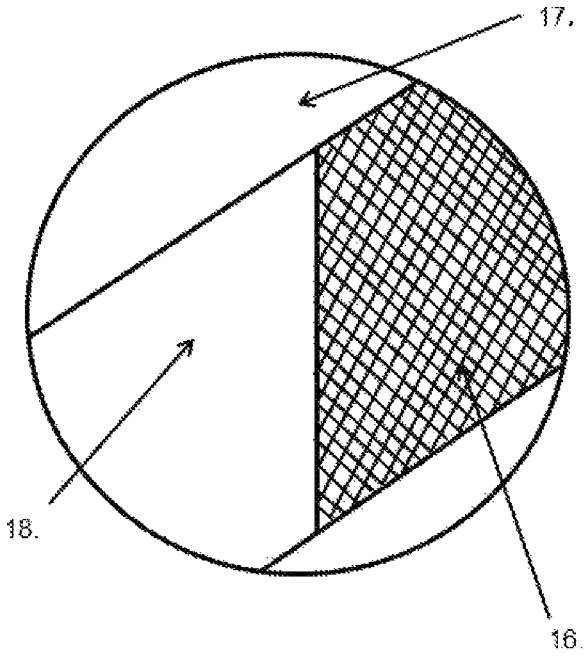
FIG. 4 shows a detailed view of the area shown circled in FIG. 3.

FIG. 4 shows detail of the edge of the joining "Channel Wall" (15) as shown in FIG. 3 for "Part" (10) of the "Quilt". FIG. 4 shows that the centre of the "Channel" wall (15), at the location where the hook tape (18) meets with the loop tape (16), Each "Part" of each "Quilt" is made this way so no matter what "Part" is purchased they will always join together by simply rotating one "Part" of the "Quilt" to join up with the other "Part" in the middle. All joining mechanisms such as zips, etc. can be made this way, although using the hook and look tape is the easiest form of manufacture The top of the "Part" (17) of the "Quilt" is also shown.

Figure 5:
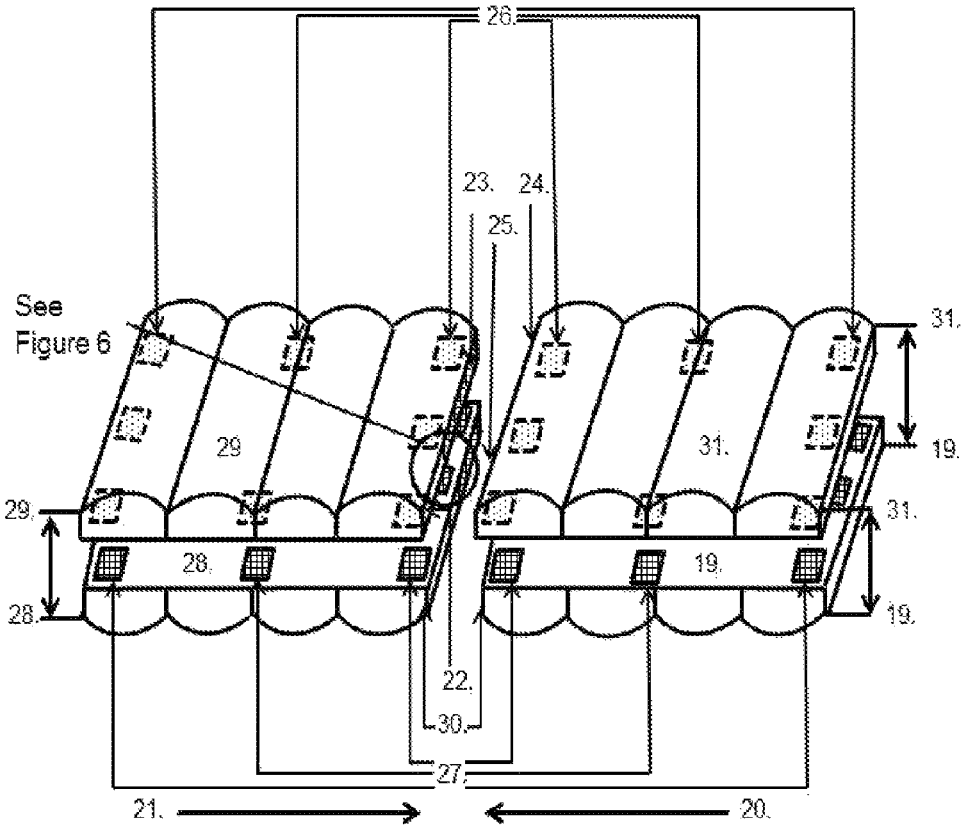
FIG. 5 is a schematic representation of a further embodiment of a Quilt According to the present invention in the "Four Seasons" style.

FIG. 5 shows a "Four Seasons" type "Quilt" according to the present invention, showing all "Portions" (19, 31, 28, 29) being joined by hook and Loop tabs. As illustrated, Hook Tabs are sewn into the bottom of the Top (26) "Portions" (31 & 29), and Loop Tabs are sewn into the top of the bottom (27) "Portions" (19 & 28), but the converse arrangement is also possible. Other forms of joining the portion together can also be used but this form of manufacture is preferred both for ease of manufacture and also ease of use. A lower "Portion" is joined to its corresponding upper (28 & 29; 19 & 31), or can be left as a single "Portion" depending on the required warmth for form a Part. Thus Portions (28,29) can be joined together to form Part (21), or either of Portions {28, 29) can be individually used as Part (21). A corresponding arrangement exists for Portions (19, 31) which independently or together for Part 20. Each "Part" (20 & 21) of the "Quilt" is then joined together in the middle through a Hook and Loop Fastener, which is sewn into the length of the joining "Channel Wall" that make up each "Part" (20 & 21) of the "Quilt" where a "Part" (20 or 21) is formed from two Portions, each Portion will include a Hook And Loop Fastener, as appropriate. One half of the "Channel Wall" is sewn with a loop fastener tape (23 & 25), and the other half is sewn with a hook fastener tape (22 & 24) Thus, no matter which "Part" (20 & 21) is purchased it will always join up with the other "Part" (21 & 21) of a "Quilt", as long as they are both manufactured in this same way. For that matter each top "Portion" (31, 29) of each "Part" (20 & 21) of the "Quilt", will always join with each other top "Portion" (31, 29) of the "Quilt" and likewise for each bottom portion. This allows three variations allowing a high degree of adjustment to cover all seasons. As an example, "Portion" (31) may be, but not restricted to, a 350 gram per square meter wool "Portion" of the "Part" (20) of the "Quilt", and "Portion" (19) maybe, but not restricted to, a 150 gram per square meter "Portion" of the "Part" (20) of the "Quilt", which would be more suitable for summer. Joined together as the full "Part" (20) they would be 500 grams per square meter, suitable for winter. "Part" (21) however could be somewhat cooler consisting of a "Portion" (29) which maybe, but not restricted to a 200 gram Polyethylene Terephthalate "Portion", and "Portion" (28) maybe, but not restricted to a 150 gram per square meter Polyethylene Terephthalate "Portion" making it substantially cooler than "Part" (20) of the "Quilt". Portion (28) could also be exchanged to replace "Portion" (19) increasing the variables in thermal resistance even further which could be useful when an individual has a fever on one side of the bed.

Figure 6:
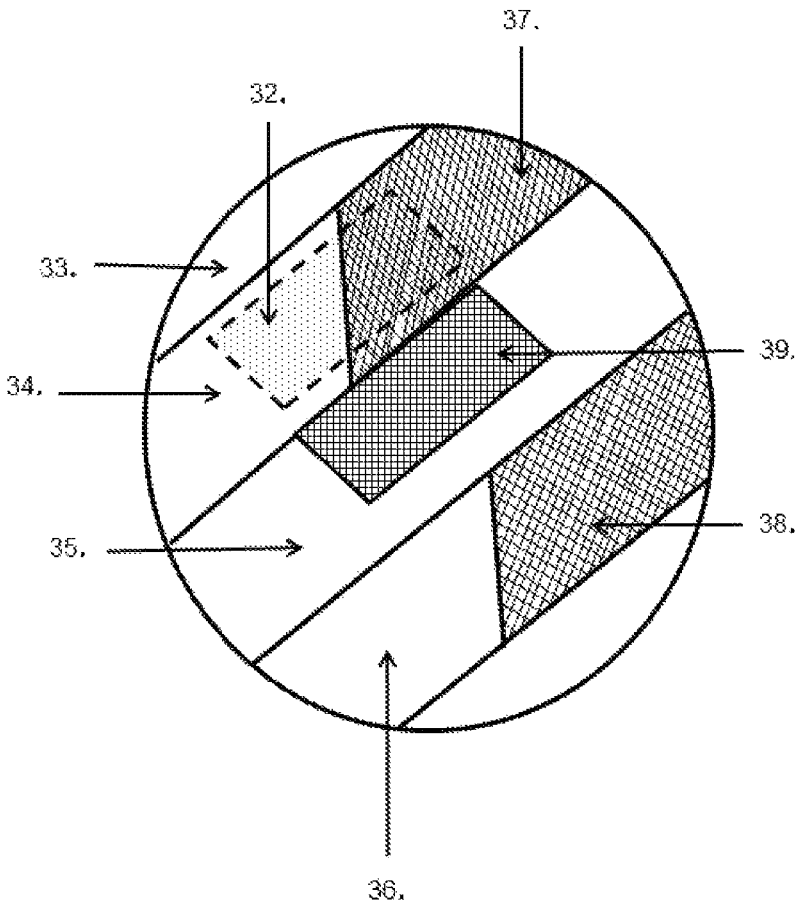
FIG. 6 shows a detailed view of the area shown circled in FIG. 5.

FIG. 6 shows the edge joining "Channel Walls" as one Part (21) of the embodiment illustrated in FIG. 5 in detail. Channel Wall (30) of FIG. 5 of both Portions (28 & 29) is sewn with both Hook Tape (34 & 36) to the middle of the joining "Channel Wall" (30), and Loop tape (37 & 38) sewn to the middle of the joining "Channel Wall" (30). All "Portions" (31, 19, 28, & 29) of the embodiment in FIG. 5 are sewn in this manner so they will always join with another "Part" or "Portion", no matter what "Part" or "Portion" is selected as long as it is manufactured in the same manner. A Loop Tab (39) is sewn into the top of the bottom "Portion" (29 in FIG. 5; 33 in FIG. 6), and a Hook Tab is sewn into the bottom of the top "Portion" (29 in FIG. 5; 33 in FIG. 6) indicated with dotted lines as it is obscured from view (32), to join the two "Portions" (28, 29, of FIG. 5) together, increased variations in thermal resistance can be obtained by adding additional Hook and Loop Fastener tabs on each "Portion" so the Bottom and Top of each "Portion" are identical in either Hook Tabs or Loop tabs, making each "Portion" and "Part" interchangeable in all combinations if need be.

The invention claimed is:

1. A Quilt Comprising;

First and second quilt parts, wherein each quilt part has a thermal resistivity and the thermal resistivity of the first quilt part is different to the thermal resistivity of the second quilt part, and wherein each quilt part has uppermost and lowermost surfaces and a channel wall disposed at a peripheral end of the quilt part, wherein the channel wall consists of a flat surface that extends between respective peripheral ends of the uppermost and lowermost surfaces of the quilt part and is orientated substantially perpendicular to the uppermost and lowermost surfaces; and has a plurality of hook or loop fasteners disposed on the flat surface, whereby, the hook or loop fasteners disposed on the flat surface of the channel wall of the first quilt part are releasably attachable to the hook or loop fasteners disposed on the flat surface of the channel wall of the second quilt part for releasably attaching the two quilt parts together and wherein the flat surface of the channel wall of each quilt part comprises:

a first surface section having a plurality of hook fasteners disposed on the first surface section, and a second surface section having a plurality of loop fasteners on the second surface section.

2. A quilt according to claim 1, wherein each quilt part has one or more attachment means disposed on the uppermost and lowermost surfaces of the quilt part, each attachment means being adapted to attach the quilt releasablity to an overlying or underlying quilt part.

3. A quilt according to claim 2, wherein at least one of the attachment means comprises hook and loop fasteners.

4. A quilt according to claim 2, wherein at least one of the attachment means comprises a zip.

* * * * *